US007381036B2

(12) United States Patent
Hundt et al.

(10) Patent No.: US 7,381,036 B2
(45) Date of Patent: Jun. 3, 2008

(54) MOTOR-PUMP UNIT

(75) Inventors: Gerd Hundt, Heidenheim (DE); Franz Arbogast, Heidenheim (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 1037 days.

(21) Appl. No.: 10/768,495

(22) Filed: Jan. 30, 2004

(65) Prior Publication Data

US 2004/0219035 A1 Nov. 4, 2004

(30) Foreign Application Priority Data

Jan. 31, 2003 (DE) ..... 103 04 121

(51) Int. Cl.
*F04C 2/10* (2006.01)

(52) U.S. Cl. ..... 418/9; 418/5; 417/356; 417/355; 417/410.4

(58) Field of Classification Search ..... 418/9, 418/5, 58, 171, 7, 166, 61.3, 209, 210, 215; 417/410.4, 355, 356, 371
See application file for complete search history.

(56) References Cited

U.S. PATENT DOCUMENTS 2,420,124 A * 5/1947 Coulson ..... 417/356
2,711,286 A * 6/1955 McAdam ..... 418/171
2,871,793 A * 2/1959 Michie et al. ..... 418/171
4,384,828 A * 5/1983 Rembold et al. ..... 417/356
4,863,357 A * 9/1989 Olofsson ..... 417/356
5,857,842 A * 1/1999 Sheehan ..... 417/410.4
6,499,966 B1 * 12/2002 Werson et al. ..... 417/355
6,551,083 B2 * 4/2003 Weisener et al. ..... 418/166
6,585,498 B2 * 7/2003 Arbogast et al. ..... 417/355
6,699,024 B2 * 3/2004 Dong ..... 418/61.3
6,733,249 B2 * 5/2004 Maier et al. ..... 418/9
6,881,041 B2 * 4/2005 Lee ..... 418/177

FOREIGN PATENT DOCUMENTS

| | | |
|---|---|---|
| DE | 1 553 157.4 | 1/1971 |
| DE | 195 38 278.1 | 5/1996 |
| DE | 198 17 162.5 A1 | 10/1999 |
| DE | 100 15 139.6 A1 | 10/2001 |
| EP | 0 611 887 A1 | 8/1994 |
| GB | 2 191 543 A | 12/1987 |

* cited by examiner

*Primary Examiner*—Thomas Denion
*Assistant Examiner*—Mary A Davis
(74) *Attorney, Agent, or Firm*—Ohlandt, Greeley, Ruggiero & Perle, L.L.P.

(57) ABSTRACT

A motor-pump unit is provided that has at least two internal gearwheel pumps axially aligned that are driven off of the rotor of the electric motor. The rotor of the electric motor is U-shaped and is concentrically disposed about the pump. The web of the U-shape is disposed in the region of the rotational axis with internal toothing that meshes with pinions of the at least two internal gearwheel pumps.

5 Claims, 1 Drawing Sheet

MOTOR-PUMP UNIT

CROSS-REFERENCE TO RELATED APPLICATIONS

This application is related to, and claims priority in, German Patent Application No. 103 04 121.4, filed on Jan. 31, 2003, the disclosure of which is incorporated in its entirety by reference herein.

BACKGROUND OF THE INVENTION

1. Field of the Invention

The present invention relates to a motor-pump unit having an electric motor and a pump. The motor and the pump are interlocked with each other.

2. Description of the Related Art

A motor-pump unit having a pump surrounded concentrically by a rotor/stator is shown in WO 01/73295.

DE 195 38 278 A1 describes a motor-pump unit. The rotor of the electric motor is simultaneously the impeller of the pump.

EP 0 611 887 A1 describes another motor-pump unit. Although the rotor of the motor is a separate component, it is connected in a torsionally rigid fashion with the cylinder block of a reciprocating pump.

These types of units reduce space. However, these units still have room for improvement.

SUMMARY OF THE INVENTION

The invention is based on the object of further improving a motor-pump unit of the kind mentioned above.

It is an object of the present invention to provide a motor-pump unit with improved performance and efficiency.

It is another object of the present invention to provide a motor-pump unit that facilitates manufacture of the unit.

It is a further object of the present invention to provide a motor-pump unit with reduced space requirements.

According to a preferred embodiment of the present invention, the motor-pump unit has at least two axially, mutually aligned, internal gearwheel pumps, as well as an electric motor, which is associated with one of the two pumps. The mutually adjacent pumps are associated with each other in such a way that they can be driven by a single electric motor. A high delivery volume and/or delivery pressure can thus be achieved.

The two pumps can be completely identical. They can also have different diameters in the conveying region, e.g., where the conveying tooth limit is located. Different types of electric motors can be used, such as, for example, asynchronous motors, reluctance motors or squirrel-cage motors.

A large variety of pumps can also be used. The present invention can be used in an especially advantageous manner in internal gearwheel pumps. The pump can form a completely independent autonomous unit. The pump can be produced separately, tested separately, and installed completely in the space enclosed by the stator of the electric motor.

The motor can be cooled with oil. The rotor of the electric motor can be held on the housing of the respective internal gearwheel pump.

These and other objects and advantages of the present invention are provided by a motor-pump unit for a medium comprising first and second internal gearwheel pumps, an electric motor and a housing. Each of the first and second internal gearwheel pumps have a pinion, an internal geared wheel eccentrically disposed therein, and a pinion shaft held by side disks. Each of the pinions are identical to the other, and the first and second internal gearwheel pumps are axially aligned. The electric motor is operably connected to at least one of the first and second internal gearwheel pumps. The electric motor has a rotor with a U-shape in an axial cross-sectional view and the rotor concentrically surrounds the at least one of the first and second internal gearwheel pumps. The rotor has an internal toothing disposed on a web of the U-shape in a region of a rotational axis of the rotor. The internal toothing meshes with the pinion shaft of each of the first and second internal gearwheel pumps. The housing encloses the electric motor, as well as the first and second internal gearwheel pumps. The motor-pump unit has a single suction connection and first and second pressure connections.

The housing can have first and second opposing ends, where the first pressure connection is disposed on the first end and the second pressure connection is disposed on the second end. The electric motor has a stator, where the stator is separated from the rotor by a gap, and the medium can flow through the gap. The second internal gearwheel pump can be connected to the second end of the housing. The motor-pump unit can also have an intermediate space between the first and second internal gearwheel pumps that circumscribes the rotational axis of the rotor, where the intermediate space is in fluid communication with the gap and the first and second internal gearwheel pumps.

BRIEF DESCRIPTION OF THE DRAWINGS

The foregoing, and still further objects and advantages of the present invention, will be more apparent from the following detailed explanation of the preferred embodiment of the invention in connection with the accompanying drawing.

DESCRIPTION OF THE INVENTION

Figure 1:
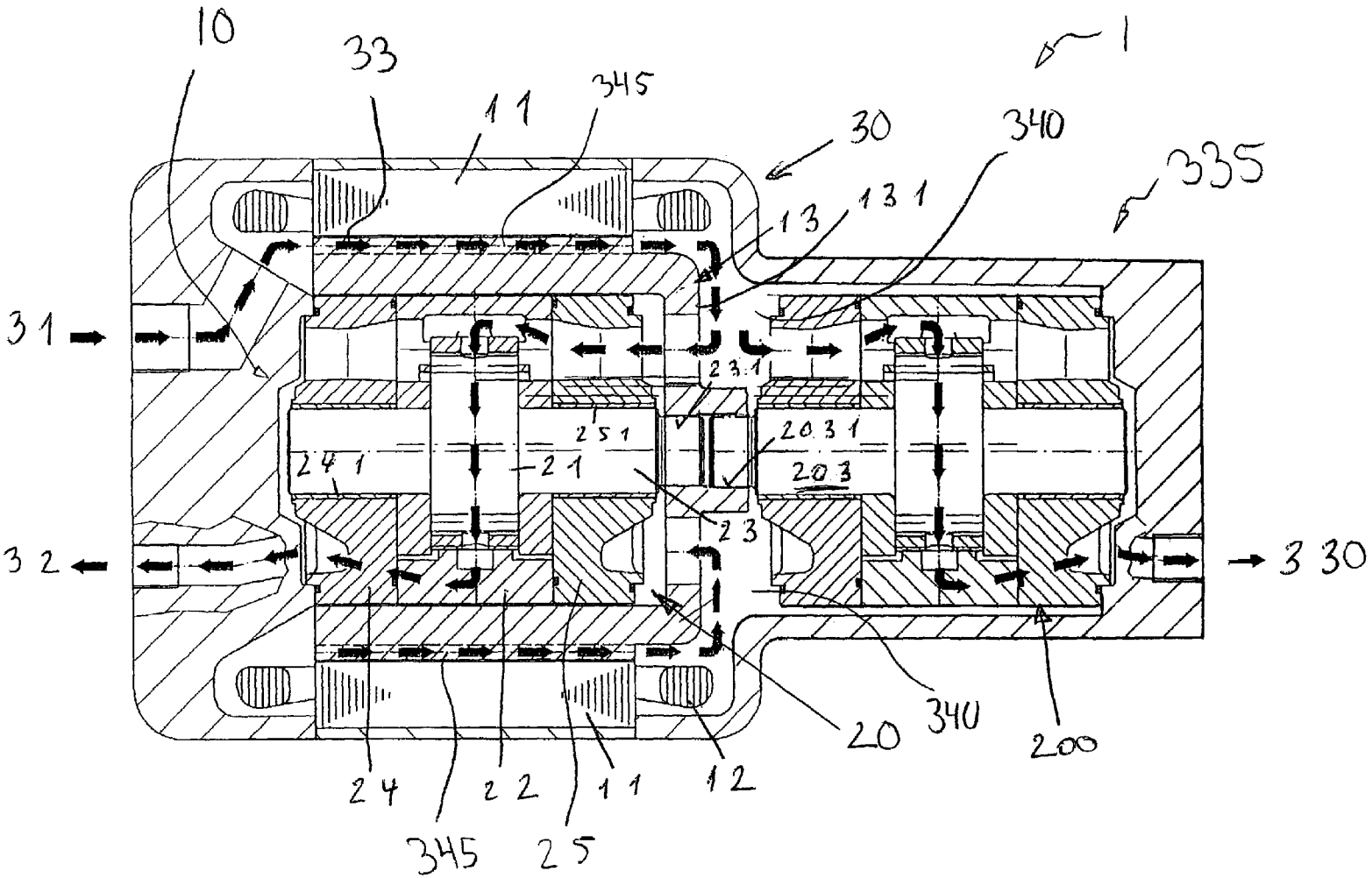
FIG. 1 is a plan cross-sectional view of a motor-pump unit of the present invention.

Referring to the drawing, there is provided a motor-pump unit generally represented by reference numeral 1. The motor-pump unit has an electric motor 10 with a stator pack 11, a winding 12 and a rotor 13.

The motor-pump unit also has a first internal gearwheel pump 20. The first internal gearwheel pump 20 has a pinion 21, an internal geared wheel 22, and a pinion shaft 23. The pinion shaft 23 is held in side disks 24, 25. In the preferred embodiment, slide bearings 241, 251 are in communication with pinion shaft 23 and side disks 24, 25, although alternative structures or methods can also be used for support or as guides.

The motor 10 and first internal gearwheel pump 20 are preferably enclosed by a common housing 30. The housing 30 has an inlet 31 and a first outlet 32 for the medium that is to be pumped. The flow path of the medium, such as, for example, oil, through motor-pump unit 1 is represented by the arrows generally identified by the reference numeral 33.

The rotor 13 of the motor 10 is configured or shaped similar to a pot or cup. In the cross-sectional view of FIG. 1, the rotor 13 appears as U-shaped and is concentrically aligned with first internal gearwheel pump 20. The pinion shaft 23 is in rotational connection or communication with the rotor 13 via a toothing 231. In the web 131 of the U-shape of the rotor 13, there is an internal toothing, whereas the pinion shaft 23 has the corresponding external toothing. The internal toothing and external toothing comb or mesh with each other.

Alternatively, other types of driving connection or communication between the rotor 13 of the motor 10 and the pinion shaft 23 could be used. Additionally, two or more toothings 231 can be used, with elements transmitting the respective torque, so that there is a translation of the speed of the rotor 13 to the pinion shaft 23 to slow or fast. The rotor 13 is held on the first internal gearwheel pump 20, and on the internal geared wheel 22 and the side disks 24, 25.

A second internal gearwheel pump 200 is provided according to the present invention. The second internal gearwheel pump 200 is arranged axially adjacent to, or aligned with, the first internal gearwheel pump 20, namely in such a way that the axes of the two pumps are in alignment with each other. The housing 30 preferably extends beyond the first internal gearwheel pump 20 and also extends around second internal gearwheel pump 200.

The second internal gearwheel pump 200 is preferably similar to, or identical with, the first internal gearwheel pump 20. The second internal gearwheel pump 200 preferably also has a pinion shaft 203 which is similar to, or identical to, the pinion shaft 23, and which is in rotational connection or communication with the rotor 13 via a toothing 2031.

The housing 30 has a second outlet 330. The second internal gearwheel pump 200 is preferably connected to, or fixed with, a right cover 335 of the housing 30.

The pot-like rotor 13 drives the two pinion shafts 23, 203 in the preferred embodiment in accordance with the present invention described-above. The oil flow path 33 is shown at the left side into inlet 31. The oil is sucked in and reaches an intermediate space or gap 340 between the two internal gearwheel pumps 20 and 200 (circumscribing the rotational axis of the rotor 13) via a gap 345 between the stator pack 11 and the rotor 13. A partial flow of oil path 33 passes through first internal gearwheel pump 20 and emerges from the first outlet 32 and a second partial flow of oil path 33 passes through the second internal gearwheel pump 200 and emerges from the second outlet 330. The motor-pump unit 1 thus has a suction connection (inlet 31) and two pressure connections (outlets 32, 330).

The preferred embodiment shows first and second internal gearwheel pumps 20, 200 that are axially aligned and driven off of rotor 13. However, the present invention and one or more of the components described herein can be used to provide for more than two internal gearwheel pumps.

The present invention having been thus described with particular reference to the preferred forms thereof, it will be obvious that various changes and modifications may be made therein without departing from the spirit and scope of the present invention as defined in the appended claims herein.

What is claimed is:

1. A motor-pump unit for a medium comprising:

first and second internal gearwheel pumps, each of said first and second internal gearwheel pumps having a pinion, an internal geared wheel eccentrically disposed therein, and a pinion shaft held by side disks, said pinions being identical to the other, said first and second internal gearwheel pumps being axially aligned;

an electric motor operably connected to at least one of said first and second internal gearwheel pumps, said electric motor having a rotor with a U-shape in an axial cross-sectional view and concentrically surrounding said at least one of said first and second internal gearwheel pumps, said rotor having an internal toothing disposed on a web of said U-shape in a region of a rotational axis of said rotor, said internal toothing meshing with said pinion shaft of each of said first and second internal gearwheel pumps; and a housing enclosing said electric motor and said first and second internal gearwheel pumps, wherein the motor-pump unit has a single suction connection and first and second pressure connections.

2. The motor-pump unit of claim 1, wherein said housing has first and second opposing ends, and wherein said first pressure connection is disposed on said first end and said second pressure connection is disposed on said second end.

3. The motor-pump unit of claim 2, wherein said second internal gearwheel pump is connected to said second end of said housing.

4. The motor-pump unit of claim 1, wherein said electric motor has a stator, wherein said stator is separated from said rotor by a gap, and wherein the medium flows through said gap.

5. The motor-pump unit of claim 4, further comprising an intermediate space between said first and second internal gearwheel pumps and circumscribing said rotational axis of said rotor, wherein said intermediate space is in fluid communication with said gap and said first and second internal gearwheel pumps.

* * * * *